United States Patent [19]

Bird

[11] 4,247,004

[45] Jan. 27, 1981

[54] STACKABLE CONTAINERS

[75] Inventor: William C. Bird, Sydney, Australia

[73] Assignee: Commonwealth Moulding Pty., Ltd., New South Wales, Australia

[21] Appl. No.: 61,876

[22] Filed: Jul. 30, 1979

[30] Foreign Application Priority Data

Jul. 28, 1978 [AU] Australia ..... PD5264

[51] Int. Cl.[3] ..... B65D 21/06; B65D 21/02

[52] U.S. Cl. ..... 206/506; 206/503; 206/505; 206/509; 220/4 D

[58] Field of Search ..... 206/503, 505, 506, 507, 206/509; 220/4 C, 4 D, 326

[56] References Cited

U.S. PATENT DOCUMENTS

| | | | |
|---|---|---|---|
| 3,175,853 | 3/1965 | Gilbertson | 220/326 |
| 3,454,189 | 7/1969 | Lauterbach | 220/326 |
| 4,015,713 | 4/1977 | Clipson | 206/509 |
| 4,015,886 | 4/1977 | Wickenberg | 206/509 |
| 4,037,750 | 7/1977 | Box | 206/505 |
| 4,105,117 | 8/1978 | Atkin | 206/506 |

FOREIGN PATENT DOCUMENTS

| | | | |
|---|---|---|---|
| 2134914 | 2/1973 | Fed. Rep. of Germany | 206/506 |
| 44884 | 9/1971 | Finland | 220/4 C |
| 553052 | 8/1974 | Switzerland | 220/4 C |

*Primary Examiner*—George E. Lowrance

*Attorney, Agent, or Firm*—Stevens, Davis, Miller & Mosher

[57] ABSTRACT

To provide security of attachment, between one container and another similar container adapted to be stacked on the top of the first container, each container has a keeper slot in one or more of its side walls adjacent the container floor and a spring leaf at the top of the container which may be bowed into either one of two stable positions. In one of these positions the leaf of one container registers with and locks within the keeper slot of a second similar container poised above the first container, and when the leaf is in the other of its stable positions it is disengaged from the keeper slot.

5 Claims, 4 Drawing Figures

STACKABLE CONTAINERS

This invention relates to crates and like containers for the carriage of eggs, fruit and other commodities. More particularly, the invention is concerned with such containers which are required to be stackable one above the other when they are packed with commodities and nestable one within the other when they are empty.

Containers of the kind indicated, as made heretofore, usually incorporate a pair of support bars or bails which are hingedly mounted on the container side walls to extend across the width of the container and across the aperture at the top level of the container, so that one container to be stacked on top of another can be rested on the two bails. When the second container is to be nested inside the first, the bails are swung clear of the first container aperture so to permit nesting of the one container deeply within the other. The bail stacking facility is satisfactory in providing the necessary support for the upper containers in a stack so long as the stack as a whole is not subjected to any disturbing forces. For example, very often these stackable containers have a large access opening in one side so that cartoned or like products packed therein may be removed without having to dismantle the stack, and experience has shown that where a retailer (for example) is trying to take a carton of eggs from a container stacked four or five containers above the floor, the mere act of trying to do this can result in one or more of the containers in the stack being toppled over.

The object of this invention is to overcome the indicated disability by the provision of simple inter-locking means whereby containers in a stack will remain in stacked condition notwithstanding the application thereto of what would normally be unstabilizing forces.

In its main aspect, the invention comprises a box or crate-like stackable container furnished with inter-locking means comprising a spring leaf mounted by its ends at the top edge portion of a wall of the container and depressible into either one of two stable positions, such that when the leaf is in its first position it over-lies the top aperture of the container, and in the second of said positions it is disposed clear to the aperture, and, a keeper hole adjacent the floor of said container; the arrangement being such that when the leaf is in its second position, the bottom of a second similar container is placeable within the top aperture of the first container, said leaf then being movable into its second position thereby to engage lockingly within the keeper hole of the first container.

An example of the invention is illustrated in the drawings herewith.

Figure 1:
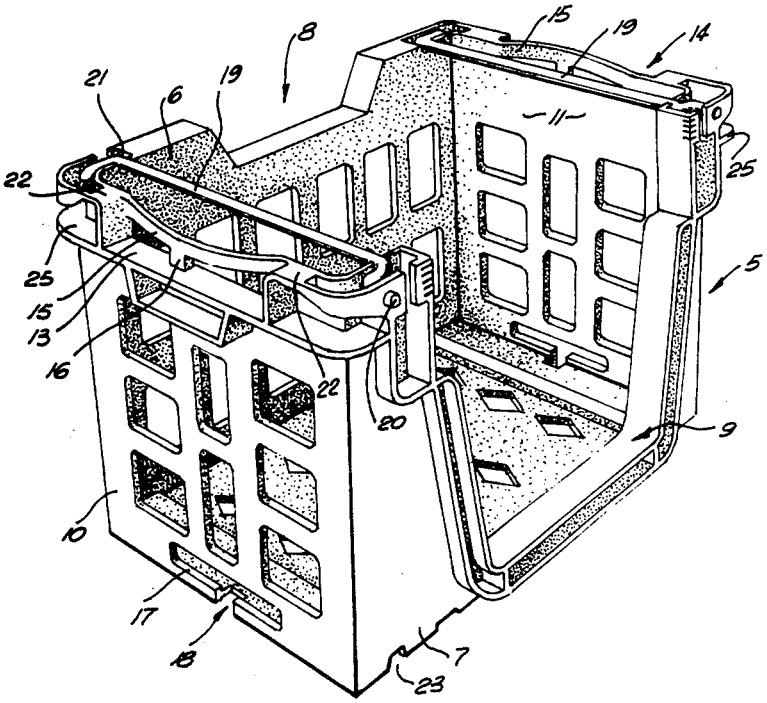
FIG. 1 is a perspective view showing a stackable container according hereto.
Figure 2:
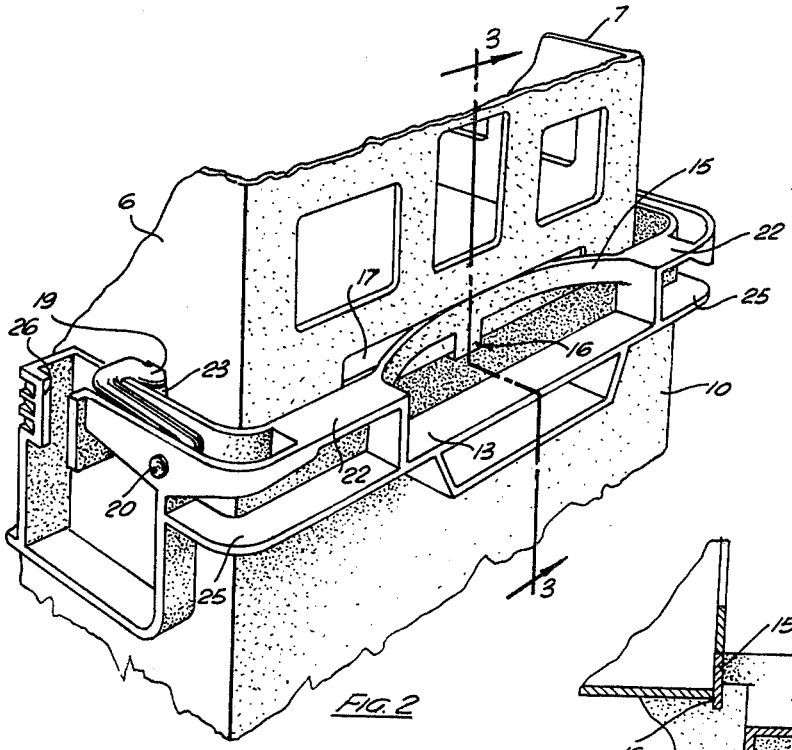
FIG. 2 is a perspective view of part of one of the containers with part of another similar container stacked above the first.

Referring to the drawings, a container 5 may have its side walls 6 and 7 gapped as indicated at 8 and 9, gap 9 being enlarged relative to gap 8 so to permit sideward removal of commodities from the container when another similar container is stacked above it. The container end walls 10 and 11 are furnished with top gaps 13 and 14 and the top of each of these gaps (13 and 14) is bridged by a resilient leaf 15, the ends of which are fixed to or integral with the sides of its gap 13 or 14. Each of the spring leaves 15 is furnished with a downwardly extending lug 16. Each of the springs 15 has two stable positions in one of which it is inwardly bowed to assume a locking position (as shown in FIG. 2) so as to over-lie the top aperture of the container, and in the other of which it is outwardly bowed to assume an unlocked position as shown in FIG. 1. The resiliency of the leaves being such that they are unable, of their own accord, to remain in any position intermediate of the two stable positions.

Each end wall of the container is furnished with a bottom keeper slot 17 having a bottom gap 18.

The perimeter of the container is furnished with conventional cranked bails 19 which are freely pivotally mounted by pivot pins 20 in holes provided in the walls of the container. These bails may each be swung into either of two significant positions. As shown in the drawings, the bails are in their working positions in which they rest in notches 21 formed in the container sides. In this position, the centre portions of the bails over-lie the interior of the container. Each of the bails may be swung out of its working position so that it then rests on a pair of flats 22 standing at the ends of the gaps 13 and 14. Each of the containers has bottom locator grooves 23 able to engage with the bails 19.

When one container is to be stacked elevatedly above another, the two bails of the lower container are swung into their working positions as shown in the drawings. The second container to be stacked above the first is lowered onto the bottom container so that its locator grooves 23 then engage with the bails 19, the upper container then rests directly above the lower container at the required stacking elevation relative thereto. When this location of one container above another is first performed, the spring leaves 15 have to be in their outwardly bowed positions as shown in FIG. 1. When the top container is positioned above the lower container as aforesaid, the keeper slots 17 of the top container are then horizontally in register with the leaves 15 of the lower. These leaves may then be depressed so that with spring snap action they engage within the slots 17 as shown in FIGS. 2 and 3, thereby to lock the top container relative to the bottom one.

Figure 3:
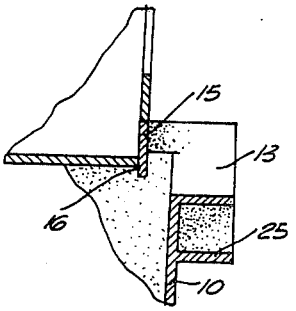
FIG. 3 is a sectional detail taken on line 3—3 in FIG. 2.

When this engagement occurs, the lugs 16 will enter the gaps 18 and extend downwardly below the floor of the top container as indicated in FIGS. 2 and 3. When the top container is to be released from the bottom container, the downwardly extending lugs 16 may be employed as finger pieces to enable the leaves 15 to be pulled into their out-bowed positions in which they are clear of the aperture 17 of the more elevated container.

It will be appreciated that some addition to the stacking stability of the containers would be obtained if there were only one spring leaf such as 15 and a keeper slot 17 for inter-engagement therewith. However, two such leaves and corresponding keeper slots, at opposite ends of the containers, as shown in the drawings, are much to be preferred. It will be further understood however, that more than two such spring leaves and corresponding slots could be provided as desired.

If a container is to be nested deeply within another empty container, the bails are swung into their non-working positions. The containers are somewhat tapered so that their walls are convergent in the downward sense, so that an upper container may be descended into a lower container to such extent that the flanges 25 of the top container then rests upon the flats 22 of the lower container.

Figure 4:
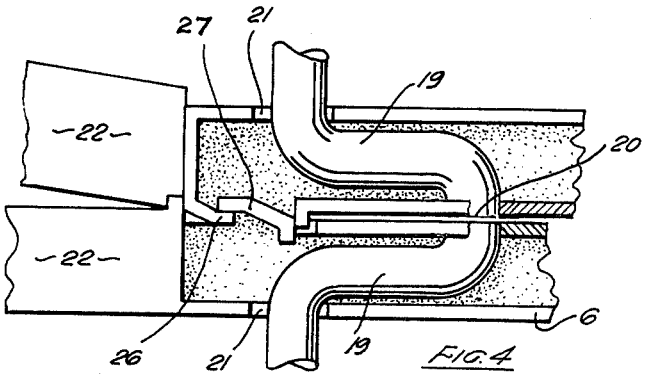
FIG. 4 is a fragmentary plan, on an enlarged scale, showing two mutually-adjacent side wall portions of two of the containers standing at the same elevation.

As an additional means of providing for stability between a pair of similar containers standing end-to-end, or side-by-side, at the same elevation, each of the containers is provided, at one side, with at least one keeper flange 26 and its opposite side is furnished with at least one complementary keeper flange 27. These keeper flanges are so positioned that when the two containers are placed together at the same elevation, the two keeper flanges of the two containers will each hook about the other, as shown in FIG. 4. For preference, each end or side of a container is furnished with two keeper flanges, one right handed and the other left-handed so that the keeper flanges at either end or side of any container may be engaged with those of any another similar container without the containers having to be placed in any particular end-for-end or side-by-side orientation of one relative to the other.

It will be appreciated that as far as the locking arrangements provided hereof in respect of containers elevatedly stackable one above the other is concerned, it is preferred that the container bottoms be tapered as previously explained herein so that in addition to being stackable, they are nestable. However, such nestability while preferable is not essential.

It will be further appreciated that, if desired, support bails such as 19 could be dispensed with and the spring leaves 15 relied upon as the sole means to support one container stacked above another.

I claim:

1. A stackable container furnished with interlocking means, comprising a floor and sidewall means upstanding therefrom to define an upwardly facing top aperture, a spring leaf mounted by its ends in an elongated opening extending generally parallel to said floor and adjacent the top edge portion of said sidewall means, said spring having a greater length than the opening in which it is mounted and depressible into either one of two stable positions, such that when the leaf is in its first position it over-lies the top aperture of the container, and in the second of said positions it is disposed clear of that aperture; and, a keeper hole adjacent the floor of said container; the arrangement being such that when the leaf is in its second position, the bottom of a second similar container is placeable within the top aperture of the first container, said leaf then being movable into its second position thereby to engage lockingly within the keeper hole of the second container.

2. A container according to claim 1 wherein said keeper hole is furnished with a bottom gap and said spring leaf has a lug to extend into and through said bottom gap so to be useable as a finger-piece for pulling said spring leaf clear of said keeper hole.

3. A container according to claim 1 or claim 2 wherein hinge-mounted, cranked bails are provided on the container to provide removable support for a second similar container stacked above the first-mentioned container.

4. A container according to claim 1 or claim 2 wherein at least one wall of said container is furnished with a keeper flange able to hook with a second keeper flange being that of a second similar container standing side-by-side with and at the same elevation as said first-mentioned container.

5. In a stackable container of the kind into which, when empty, a second similar container is able to nest with the bottom of the second container descended substantially to the floor level of the first of said containers; means for supporting and locking a second container elevatedly on a first container, said means comprising:

(a) in respect of at least the first container, a pair of support members mounted on the container so as to be movable into a first position in which said members extend across the open top of the container and a second position in which said members are laterally displaced from the open top of the container;

(b) locking means comprising a spring leaf mounted by its ends at the top edge portion of a wall of the container and depressible into either one of two stable positions, such that when the leaf is in its first position it over-lies the open top of the container and in the second of said positions it is disposed clear of that open top; and, (c) a keeper hole adjacent the floor of at least the second container;

the arrangement being such that when said support members are in their first position and said leaf is in its second position, the bottom of a second container is placeable within the open top of the first container, said leaf then being movable into its first position thereby to engage lockingly within the keeper hole of the second container.

* * * * *